US009889911B1

(12) United States Patent
Stella et al.

(10) Patent No.: US 9,889,911 B1
(45) Date of Patent: Feb. 13, 2018

(54) BACK PACK CINCH

(71) Applicants: Joseph B. Stella, Ipswich, MA (US); Bradley E. Lally, San Diego, CA (US); Corrado Cominetti, Genoa (IT); Alberto Belloni, Genoa (IT)

(72) Inventors: Joseph B. Stella, Ipswich, MA (US); Bradley E. Lally, San Diego, CA (US); Corrado Cominetti, Genoa (IT); Alberto Belloni, Genoa (IT)

(73) Assignee: Johnson Outdoors Inc., Racine, WI (US)

( * ) Notice: Subject to any disclaimer, the term of this patent is extended or adjusted under 35 U.S.C. 154(b) by 0 days.

(21) Appl. No.: 15/273,238

(22) Filed: Sep. 22, 2016

(51) Int. Cl.
*B63C 11/22* (2006.01)
*A45F 3/10* (2006.01)
*A62B 25/00* (2006.01)

(52) U.S. Cl.
CPC ..... *B63C 11/22* (2013.01); *A45F 3/10* (2013.01); *A62B 25/00* (2013.01); *B63C 2011/2281* (2013.01)

(58) Field of Classification Search
CPC ..... B63C 11/22; B63C 2011/2281; B63C 2011/026; B63C 2011/085; B63C 11/2245; B63C 2011/303; B63C 2011/306; A62B 25/00; A62B 9/04; Y10T 24/2143; Y10T 24/2145; Y10T 24/2147; Y10T 24/216; Y10T 24/2117; Y10T 24/4086; Y10T 24/4047; Y10T 24/4077; Y10T 24/44248; Y10T 24/45079
USPC ..... 405/185–187
See application file for complete search history.

(56) References Cited

U.S. PATENT DOCUMENTS 3,033,431 A * 5/1962 Henderson ..... B63C 11/30 224/604
3,957,183 A 5/1976 Gadberry
4,310,110 A 1/1982 Dexter
4,690,314 A 9/1987 Faulconer et al.
(Continued)

FOREIGN PATENT DOCUMENTS

EP 0 215 704 A1 3/1987
JP 08-258788 A 10/1996

OTHER PUBLICATIONS

Halcyon Traveler BC System | Diving—diveinstinct.com; 3 pages printed from the internet; date last visited Mar. 7, 2015; http://diveinstinct.com/halcyon-traveler-bc-system-1042.
(Continued)

*Primary Examiner* — Carib A Oquendo
(74) *Attorney, Agent, or Firm* — Reinhart Boerner Van Deuren P.C.

(57) ABSTRACT

A back pack for an underwater breathing gas tank is provided. The back pack includes a tank mounting structure having a front surface facing away from an underwater breathing gas tank when an underwater breathing gas tank is operably mounted to the tank mounting structure. The tank mounting structure defines a recess. The front surface defines an opening of the recess. The tank mounting structure defines a bottom surface of the recess opposite the opening in the front surface. The back pack includes a strap and a buckle. The buckle has a latched state for securing the strap in a fixed position for securing an underwater breathing gas tank to the tank mounting structure. The buckle, when in a latched state, is positioned at least partially within the recess.

11 Claims, 5 Drawing Sheets

(56) References Cited

U.S. PATENT DOCUMENTS

| | | | | |
|---|---|---|---|---|
| 4,778,307 | A | 10/1988 | Faulconer | |
| 5,046,894 | A | 9/1991 | Bergstrom | |
| 5,346,419 | A | 9/1994 | Kaiser | |
| 5,378,084 | A | 1/1995 | Walters et al. | |
| 5,567,084 | A | 10/1996 | Oliver | |
| 5,626,439 | A | 5/1997 | Rowlands | |
| 5,662,433 | A | 9/1997 | Seligman | |
| 6,402,429 | B1 | 6/2002 | James | |
| 6,409,429 | B1 | 6/2002 | Belloni | |
| 6,503,114 | B2 | 1/2003 | Kawashima et al. | |
| 6,749,370 | B1 | 6/2004 | Urabe et al. | |
| 6,805,519 | B1 | 10/2004 | Courtney | |
| 7,001,107 | B2 | 2/2006 | Matsuoka | |
| 7,052,211 | B1 | 5/2006 | Curry | |
| 7,367,749 | B2 | 5/2008 | Kim | |
| 7,540,690 | B2 | 6/2009 | Garcia et al. | |
| 8,006,877 | B2 | 8/2011 | Lowry et al. | |
| 8,398,337 | B2 | 3/2013 | Jablonski | |
| 2006/0175492 | A1 | 8/2006 | Cooper | |
| 2015/0144674 | A1* | 5/2015 | Losos ..... | A62B 9/04<br>224/633 |

OTHER PUBLICATIONS

Halycon Cinch Quick—Adjust Harness Upgrade; 3 pages printed from the internet; date last visited Mar. 7, 2015; http://add-helium.shoplightspeed.com/halcyon-halcyon-standard-cinch-quick-adjust-harnes.html.

* cited by examiner

BACK PACK CINCH

FIELD OF THE INVENTION

This invention generally relates to a back pack for an underwater breathing gas tank.

BACKGROUND OF THE INVENTION

A back pack for underwater diving generally is worn by a diver to secure the diver to his underwater breathing gas tank (hereinafter, "gas tank"). The diver's back is on one side of the backpack and a gas tank is on the other side of the back pack.

The back pack may have a strap that joins the gas tank to the back pack for a diver's use during diving. The strap length as it surrounds the gas tank is generally lessened to tighten the gas tank connection to the back pack. Once the desired length around the gas tank is reached to properly keep the gas tank connected to the back pack, the length of the strap is generally fixed by a device such as a cinch that is hereinafter referred to interchangeably as a buckle.

The buckle generally permits the length of the strap to be adjusted as desired for a tight fit during the dive and thereafter a loose fit such that the gas tank may be replaced. For example, one such buckle is shown in U.S. Pat. No. 5,567,084 where a buckle is shown located on the side of the gas tank farthest away from a diver's back. The buckle is left unprotected on the surface of the its gas tank such that any structure that the diver may inadvertently hit or any object, including another diver may hit the buckle on the exposed surface where it is located. Unfortunately, such a buckle may become unlatched when struck such that its strap can loosen such that the gas tank may separate from the back pack.

The invention seeks to provide a back pack that offers greater protection than heretofore known for a back pack that includes a buckle that secures the backpack to the gas tank. These and other advantages of the invention, as well as additional inventive features, will be apparent from the description of the invention provided herein.

BRIEF SUMMARY OF THE INVENTION

In one aspect, the invention provides a back pack for an underwater breathing gas tank comprising a tank mounting structure. The tank mounting structure has a front surface facing away from an underwater breathing gas tank when an underwater breathing gas tank is operably mounted to the tank mounting structure. The tank mounting structure defines a recess. The front surface of the tank mounting structure defines an opening of the recess. The tank mounting structure also defines a bottom surface of the recess opposite the opening in the front surface. The back pack further comprises a strap and a buckle. The buckle has a latched state for securing the strap in a fixed position for securing a underwater breathing gas tank to the tank mounting structure. The buckle, when in a latched state, is positioned at least partially within the recess.

In another aspect, the invention provides a back pack for an underwater breathing gas tank comprising a tank mounting structure having a front surface facing away from an underwater breathing gas tank when a gas tank is operably mounted to the tank mounting structure. The tank mounting structure defines a recess. The front surface defines an opening of the recess. The tank mounting structure defines a bottom of the recess opposite the opening in the front surface. The back pack further comprises a buckle having a latched state for securing a strap in a fixed position for securing an underwater breathing gas tank to the tank mounting structure. The buckle has a handle portion that passes through the opening of the recess when the buckle transitions from an unlatched state to the latched state.

In yet another aspect, the invention provides a back pack for an underwater breathing gas tank comprising a first mounting plate and a second mounting plate releasably coupled to one another. The first and second mounting plates define a tank mounting structure having a front surface facing away from an underwater breathing gas tank when a gas tank is operably mounted to the tank mounting structure. The tank mounting structure defines a recess. The front surface defines an opening of the recess. The tank mounting structure defines a bottom surface of the recess opposite the opening in the front surface. The back pack further comprises a dive bladder releasably coupled between the first and second mounting plates. The back pack may include a buckle and a strap. The buckle may be an over the center buckle. The buckle secures the strap to fix a length of the strap surrounding an underwater breathing gas tank, the dive bladder and the tank mounting structure. The buckle is located at least partially within the recess when the strap is secured.

In an embodiment of the back pack, the buckle may be pivotably attached to the tank mounting structure for rotation about a first rotational axis. The buckle may be an over-center mechanism such that in the latched state, the strap generates a torque on the latch in a first direction around the rotational axis biasing the latch toward the latched state and, in the unlatched state, any torque generated by the strap biases the buckle in an opposite second direction around the rotational axis toward the unlatched state. Unlike a traditional over-center mechanism the buckle remains in a latched state without an additional locking mechanism.

In another embodiment, the tank mounting structure includes a first mounting plate that defines, at least in part, the recess. The tank mounting structure also may include a second mounting plate that defines at least in part, the bottom of the recess opposite the opening in the front surface. The second mounting plate may be located between the first mounting plate and a gas tank when a gas tank is mounted to the tank mounting structure. A dive bladder may be fixed between the first mounting plate and the second mounting plate.

In yet another embodiment, the strap may extend around at least a portion of the gas tank when operably mounted to the tank mounting structure. The strap has a first end and a second end. The first end is attached to the buckle and the second end is adjustable relative to the buckle to fix a length of the buckle when the buckle is in the latched state such that underwater breathing gas tanks of different sizes can be secured to the tank mounting structure.

In another embodiment, the buckle, in the latched state, is between the front surface of the tank mounting structure a diver's back when a gas tank is operably connected to the tank mounting structure and a diver.

In an embodiment, in the latched state, the buckle is in the recess and does not extend out of the opening. In transition between the unlatched state and the latched state, a handle portion of the buckle extends out of the opening beyond the front surface.

In another embodiment, the opening of the recess in the tank mounting structure includes a portion that extends into a side of the tank mounting structure as well as the front surface. A handle portion of the buckle extends into the portion of the recess that extends into the side of the tank mounting structure when the buckle is in the unlatched state. The tank mounting structure defines an outer periphery and the handle extends out of the outer periphery defined by the tank mounting structure in the unlatched state and is at least partially within the outer periphery in the latched state.

In still another embodiment, the buckle in the latched state is positioned within the recess between the bottom surface and the opening in the front surface.

In an embodiment, the buckle is an over center buckle. The tank mounting structure defines an outer periphery. The handle portion may be positioned at least partially within the outer periphery defined by the tank mounting structure when the buckle is in the latched state.

In an embodiment, the handle may extend out of the recess and the outer periphery when the buckle is in the unlatched state.

In yet another embodiment, the handle portion is positioned entirely within the outer periphery defined by the tank mounting structure when the buck is in the latched state.

In another embodiment, the tank mounting structure includes a first mounting plate and a second mounting plate. The first mounting plate includes a top portion, a middle portion, and a bottom portion. The top and bottom portions may each have a mounting aperture for mounting a second mounting plate. The top portion of the first mounting plate comprises a top concave portion of the front face of the tank mounting structure. The top portion may comprise a carrying handle. The carrying handle extends away from an underwater breathing gas tank when a gas tank is operably mounted to the tank mounting structure. The middle portion includes the recess and defines a first side wall and a second side wall of the recess. The bottom portion defines a bottom concave portion of the front surface of the tank mounting structure. The bottom portion has opposed wings extending away from a gas tank when operably coupled to the tank mounting structure.

In still another embodiment, the first mounting plate includes a handle and the back pack is transportable via the handle.

In another embodiment, the second mounting plate includes a top, middle and bottom portion. The middle portion defines channel having a top wall, a bottom wall and a portion of the bottom of the recess.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
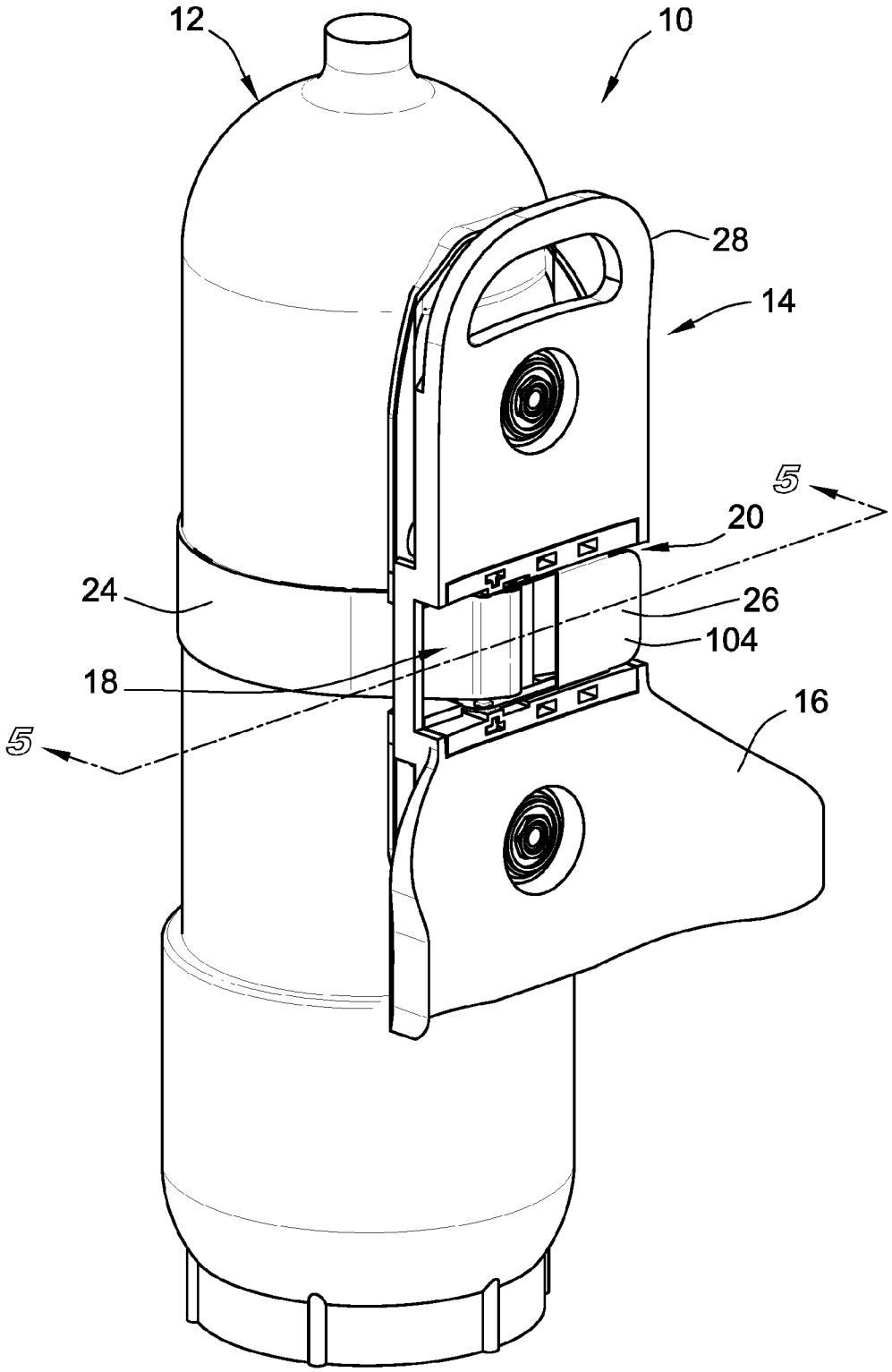
FIG. 1 is a perspective view of a back pack having a buckle in a latched state, the back pack operably connected to an underwater breathing gas tank.

FIG. 1 illustrates a back pack 10 for an underwater breathing gas tank 12. The back pack 10 includes a tank mounting structure 14 having a front surface 16 that faces away from an underwater breathing gas tank 12 when the underwater breathing gas tank 12 is operably mounted to the tank mounting structure 14. The front surface 16 faces towards a diver's back (not illustrated) when the back pack 10 is operably coupled to a diver for diving operations. The tank mounting structure 14 defines a recess 18. The front surface 16 of the tank mounting structure 14 defines an opening 20 of the recess 18. The tank mounting structure 14 defines a bottom surface 22 (FIG. 2) of the recess 18. The bottom surface 22 of the recess 18 is opposite the opening 20 in the front surface 16.

The back pack further includes a strap 24 and a buckle 26. The strap 24 and buckle 26 cooperate, as will be discussed in greater detail below, to permit the length of the strap 24 to be infinitely adjusted (as opposed to straps that are pre-configured for fixed/discrete lengths) as its surrounds an underwater breathing gas tank 12 to secure the underwater breathing gas tank 12 to the back pack 10. The infinite adjustability provided by the buckle 26 and strap 24 advantageously allow for varying diameters of underwater breathing gas tanks to be couple to the back pack 10. As will be discussed in greater detail below, the buckle 26 of the back pack 10 has a latched state (FIG. 1) and an unlatched state (FIG. 5) to permit adjustment of the length of the strap 24.

In the latched state, the buckle 26 fixes the length of the strap 24 surrounding the tank mounting structure 14 and underwater breathing gas tank 10 so as to tightly secure an underwater breathing gas tank 12 to the tank mounting structure 14. The strap 24 in the latched state cannot move unless the buckle 26 is unlatched to allow the strap 24 to be adjusted.

As illustrated in FIG. 1, the buckle 26 in the latched state may be positioned within the recess 18 between the bottom surface 22 of the recess 18 and the opening 20 defined by the front surface 16. The opening 20 of the recess 18 in the tank mounting structure 14 includes a portion that extends into a side 19, 21 of the tank mounting structure 14 as well as the front surface 16. The buckle 26, in the latched state, is in the recess 18 between an underwater breathing gas tank 12 and a diver's back when the underwater breathing gas tank 12 is operably connected to the tank mounting structure 14 and a diver. In the latched state, the buckle 26 may be in the recess 18 and does not extend out of the opening 20 either through the sides 19, 21 or front surface 16. However, in other embodiments, the buckle 26 in the latched state is positioned partially within the recess 18 and may extend at least partially beyond any one or more of the opening 20, front surface 16, and sides 19, 21. In such embodiments, the buckle 26 is still advantageously positioned between the bottom surface 22 and a diver's back when the back pack 10 is operably worn on a diver's back.

Further, the tank mounting structure 14 defines an outer periphery 28 of the tank mounting structure 14. In the latched state, a handle 104 of the buckle 26 does not extend out of, that is beyond, the outer periphery 28 defined by the tank mounting structure 14. The handle in the latched state is completely positioned within the outer periphery 28 of the tank mounting structure 14 to prevent it from becoming inadvertently unlatched. On the other hand, in the unlatched state of the buckle 26 (FIG. 5), the handle 104 extends out, that is beyond the outer periphery 28 defined by the tank mounting structure 14 and in the unlatched state the handle 104 is partially located outside the recess 18.

The latched buckle 26 located entirely inside the recess 18 provides an advantage for a diver utilizing the back pack 10 for securing an underwater breathing gas tank 12 to the tank mounting structure 14. During a dive, a diver's back faces the front surface 16 of the tank mounting structure 14. As such, the diver's back advantageously acts as a protective cover over the recess 18 concealing the buckle 26 within it. Further, the bottom surface 22 of the recess 18 protects the opposite side of the buckle 26 within the recess 18 from hitting structure or being hit by objects during a dive. In this way, the buckle 26 is protected within the recess 18 from being inadvertently hit or bumped by an object or structure that would cause the buckle 26 to come unlatched and separate the underwater breathing tank 12 from the back pack 10.

Figure 2:
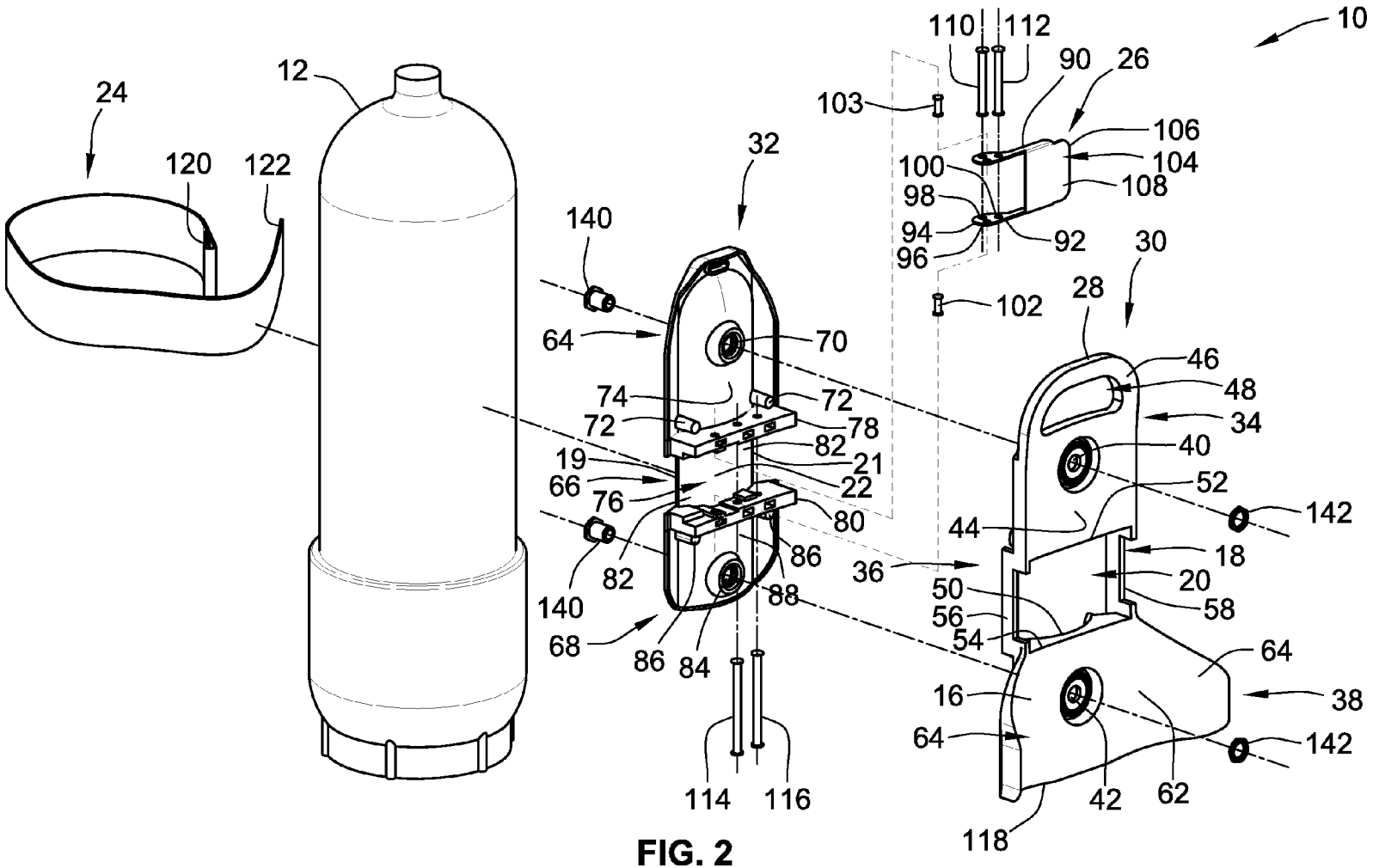
FIG. 2 is an exploded view of the back pack of FIG. 1.

Turning now to the exploded view of the back pack 10 as illustrated in FIG. 2, the tank mounting structure 14 of FIG. 1 will be discussed in greater detail. The tank mounting structure 14 may include a first mounting plate 30 that defines, at least in part, the recess 18 and a second mounting plate 32. The first mounting plate 30 has a top portion 34, a middle portion 36, and a bottom portion 38. The top portion 34 has a top mounting aperture 40. The bottom portion 38 has a bottom mounting aperture 42. The mounting apertures 40, 42 are for securing the first mounting plates to the second mounting plate 32. In alternative embodiments, the tank mounting structure 14 may be made of a single mounting plate. Further, as can be readily appreciated the structures and contours, such as recess 18 and handle 28, may be made in certain embodiments on either one of the plates or in embodiments that comprise only a single mounting plate for the tank mounting structure.

The top portion 34 of the first mounting plate 30 further includes a top concave portion 44 of the front face 16 of the tank mounting structure 14 and a carrying handle 46. The carrying handle 46 is canted such that it extends away from a gas tank 12 when the underwater breathing gas tank 12 is operably mounted to the tank mounting structure 14. The handle 46 includes a handle aperture 48 that extends through the front surface 16 and a back surface 50 of the first mounting plate 30. The back pack 10 can be advantageously transported via the handle 46 built into the first mounting plate 30. As previously discussed, in yet other embodiments, the handle 46 may be built into or carried by the second mounting plate 32 and in yet other embodiments where the tank mounting structure 14 is a single mounting plate, the handle 46 may be built into or carried by the single mounting plate. One of the advantages of the handle 46 position is that the handle 46 does not interfere with either the underwater breathing gas tank 12 or the diver during a dive because of its advantageous extension away from the underwater breathing gas tank 12 while at the same time allowing tight contact between the back pack 10, the diver and an underwater breathing gas tank 12. The top portion 34 of the tank mounting structure 14 extends longitudinally between the outermost periphery 28 at the carrying handle 46 and an upper edge 52 of the opening 20 of the recess 18 in the front surface 16.

The middle portion 36 of the first mounting plate 30 extends longitudinally between the upper edge 52 and a bottom edge 54 of the opening 20 of the recess 18 in the front surface 16. The middle portion 36 includes the recess 18 and a first side wall 56 and a second sidewall 58 of the recess 18. The sidewalls 56, 58 are in opposed space relation.

The bottom portion 38 of the first mounting plate 30 extends longitudinally between the bottom edge 54 of the opening of the recess 18 and a bottom 118 of the first mounting plate 30. The bottom portion 38 defines a bottom concave portion 62 of the front surface 16 of the tank mounting structure 14. The bottom portion 38 further includes opposed wings 64 that extend away from an underwater breathing gas tank 12 when operably coupled to the tank mounting structure 14. The opposed wings 64 advantageously provide for a tight fit between the back pack 10 and a diver. The advantageous contour of the wings 64 together with the bottom concave portion 62 conform to the contour of the diver's back to provide for the comfortable and tight fit.

The tank mounting portion 14 also includes the second mounting plate 32. The second mounting plate 32 defines, at least in part, the bottom surface 22 of the recess 18 opposite the opening 20 in the front surface 16. The second mounting plate 32 is located between the first mounting plate 30 and the underwater breathing gas tank 12 when the underwater breathing gas tank 12 is mounted to the tank mounting structure 14. The second mounting plate 32 includes a top portion 64, middle portion 66 and bottom portion 68 that are designed to mount to top portion 34, the middle portion 36, and the bottom portion 38 of the first mounting plate, respectively. The top portion 64 includes a top apertured mounting boss 70. The top 64 further includes top male mounting members 72 in spaced relation. The top portion 64 further includes a convex front surface 74.

The middle portion 66 of the second mounting plate 32 defines u shaped channel 76 having an upper wall 78, a lower wall 80 and a bottom wall 82. The bottom wall 82 includes the bottom surface 22 of the recess 18 and extends between the upper and lower walls 76, 78. Although a u shaped channel is illustrated, it may be readily appreciated that the channel may take other shapes provided that the buckle 26 is permitted to remain at least partially between bottom surface 22 of the recess and the diver's back when an underwater breathing gas tank 12 is operably connected to the tank mounting structure 14 and a diver.

The bottom portion 68 of the second mounting plate 32 includes a bottom apertured mounting boss aperture 84 and bottom male mounting members 86 in opposed space relation. The bottom portion 68 further includes a bottom convex front surface 88.

Still with respect to FIG. 2, buckle 26 of the back pack 10 is illustrated. Buckle 26 includes an upper arm member 90 and a lower arm member 92 that are spaced apart from one another. The arm members 90, 92 are generally parallel and mirror symmetric to one another and as such the lower arm 92 will be described as the upper arm 90 mirrors the lower arm 92. The lower arm member 92 has at a first end 94, a first aperture 96, a second aperture 98 and a third aperture 100. A bottom mounting pin 102 passes through the first aperture 96 and into the lower wall 80 to pivotally connect the buckle 26 to the second mounting plate 32. A top mounting pin 103 passes through an aperture in the upper arm 90 and into the upper wall 78 to pivotally connect the buckle 26 to the second mounting plate 32. The bottom mounting pin 102 and the top mounting pin 103 define an axis of rotation 124 (see FIG. 5) about which the buckle 26 may pivot to provide the over the center function to secure the strap 24 in moving from the unlatched state (FIG. 5) to the latched state (FIG. 6). However, unlike a traditional or standard cam over-center buckle, buckle 26 remains closed, that is, remains in a latched state by itself with no additional locking mechanism necessary. Further, although a cinch in the form of buckle 26 is discussed with respect to the illustrated embodiment, it may be readily appreciated the cinch is not limited to embodiments of buckle 26. Other embodiments with varying structures for the cinch may be utilized to provide the over center function.

The buckle 26 is manipulated by a diver between its latched state and unlatched state via the buckle handle 104 located at a second end 106 of the buckle 26 opposite the first end 94. The buckle handle 104 has a generally rectangular buckle face 108. Buckle handle 104 connects upper arm member 90 and lower arm member 92. Further, connection between the upper arm member 90 and lower arm member is provided by a first buckle pin 110 having a first end that is fixed in the second aperture 98 of the lower member 92 and a second end that is fixed in the corresponding aperture of the upper arm member 90. A second buckle pin 112 has a first end that pass into the third aperture 100 of the lower arm member 92 and a second end that is fixed in the corresponding aperture of the upper arm member 90.

Buckle pins 110, 112 may be press fit into the apertures, welded or soldered so as to connect the upper 90 and lower 92 arm members via buckle pins 110, 112. In yet other embodiments, the buckle pins 110, 112 may pass through the buckle 26 through either or both of upper 90 and lower 92 members to connect to tank mounting structure 14. In the embodiment illustrated, buckle pins 110 and 112 permit the strap 24 to change direction as it passes through the buckle 26 so as to create the necessary torque and friction to allow the over the center function of the buckle 26 to fix the length of the strap 24.

In addition to buckle pins 110,112 recess pins 114 and 116 assist in the over the center function of the buckle 26. Recess pins 114, 116 do not pass through the buckle 26 but do traverse and thereby connect upper wall 78 of the second mounting plate 32 with lower wall 80 of the recess 18 to create a pathway through which strap 24 may pass. Strap 24 has a first end 120 that wraps around and may pivotally attach to recess pin 116 while a second end 122 of the strap 24 is free to pass around the underwater breathing gas tank 12 and then back into the recess 18 and through buckle 26 to fix the length of the strap 24 so as to tightly hold the back pack 10 to the underwater breathing gas tank 12.

Figure 3:
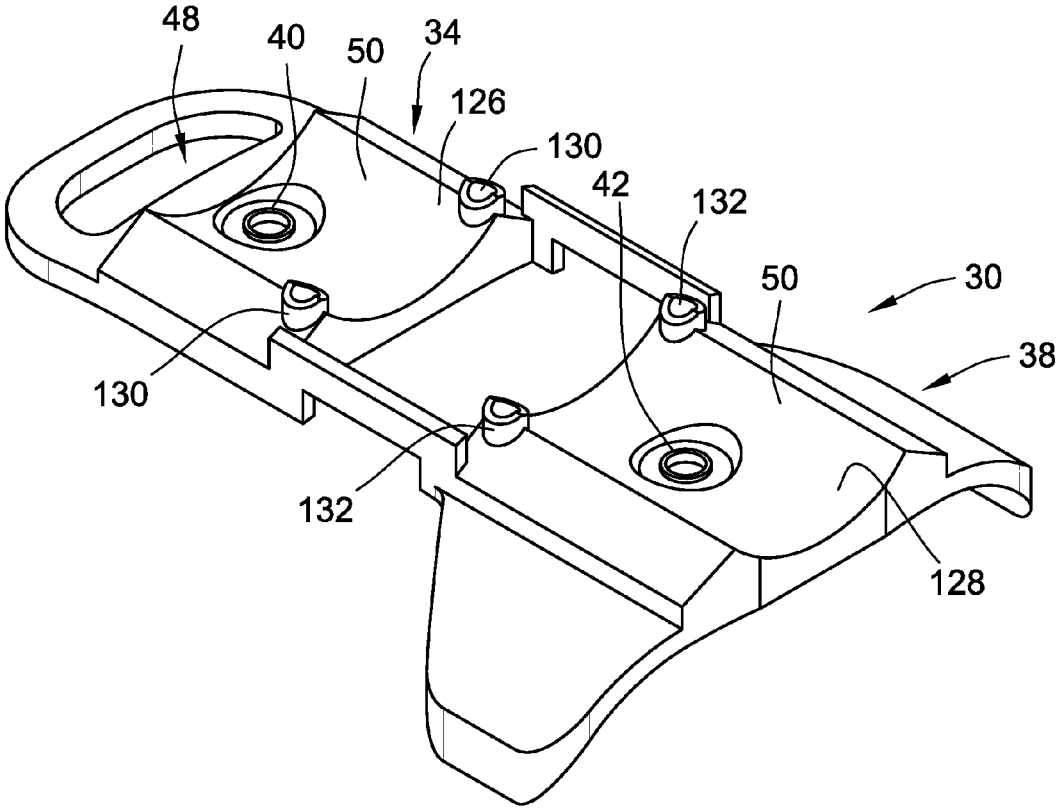
FIG. 3 is a perspective view of the back face of the first mounting plate of the tank mounting structure of the back pack of FIG. 1.

Turning to FIG. 3, the back surface 50 of the first mounting plate 30 is illustrated. The top mounting aperture 40 and bottom aperture 42 traverse the front surface 16 and back surface 50 as does the handle aperture 48. The back surface 50 of the top portion 34 of the first mounting plate 30 also defines a top back concave surface 126. The back surface 50 of the bottom portion 38 of the first mounting plate 30 also defines a bottom back concave surface 128. The back concave surfaces 126, 128 are, respectively, complimentary to the top convex front surface 74 of the top portion 64 of the second mounting plate 32 and the bottom convex front surface 88. The back concave surfaces 126, 128 are advantageously contoured to compliment and mate with, respectively, the top convex surface 74 and bottom convex surface 88 of the second mounting plate 32 when joined to the first mounting plate 30.

The back surface 50 of the first mounting plate 30 also includes a pair of back top portion receiving apertures 130 and back bottom portion receiving apertures 132. The receiving apertures 130, 132 are complimentary to and receive, respectfully top male mounting members 72 and bottom male mounting members 86 to provide a press fit there between when the first mounting plate 30 and second mounting plate 32 are joined. So too, it can be readily appreciated that the top and bottom apertured mounting bosses 70 and 84 mate with and are received into, respectively, the top and bottom mounting apertures 40, 42.

Figure 4:
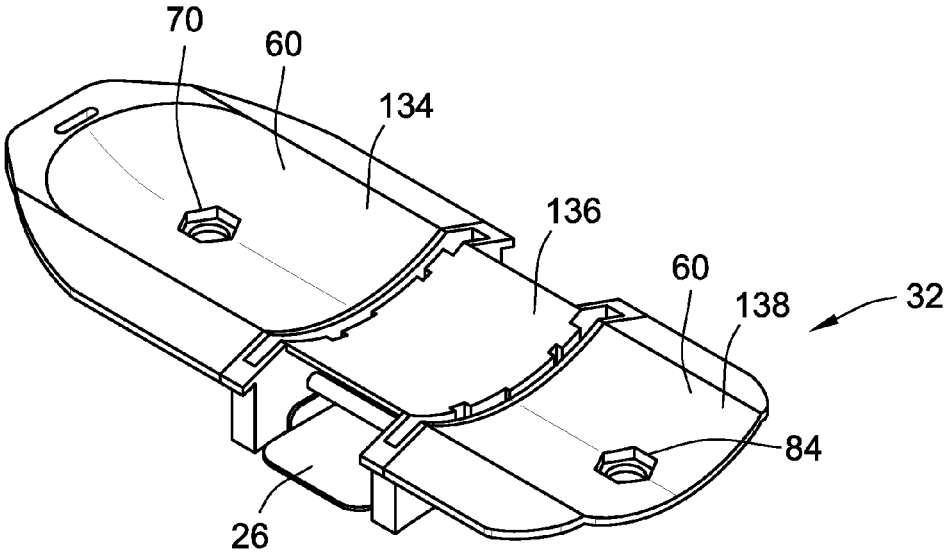
FIG. 4 is a perspective view of the back face of the second mounting plate of the tank mounting structure of the back pack of FIG. 1.

Turning to FIG. 4, the back surface 60 of the second mounting plate 32 is illustrated. The back surface 60 includes concave back top surface 134, the concave back bottom wall surface 136 and concave back bottom surface 138. The apertures of the top and bottom apertured mounting bosses 70, 84 extend, respectively through the concave back top and bottom surfaces 134, 138. The concave back surfaces 134, 136, 138 advantageously conform with the convex surface of the underwater breathing gas tank 12 to provide a tight fit when joined together during diving operations. Concave back bottom wall surface 136 advantageously protects in part the buckle 26 in its latched state in recess 18 such that buckle 26 cannot be hit by an obstacle or structure during a dive.

As illustrated in FIGS. 2-4 the first mounting plate 30 and second mounting plate 32 may be releasably connected. The convex surfaces 74, 88 of the second mounting plate 32 are complimentary to the concave surfaces 126,128 of the first mounting plate 30 and cooperate in their contoured fit to assist in joining with strength the first and second mounting plates 30, 32. So too, the male mounting members 72, 74 insert, respectively, into receiving apertures 130, 132 to provide a press fit between the first and second mounting plates 30, 32. Moreover, the top and bottom apertured mounting bosses 70, 84 of the second mounting plate 32 are received into the top and bottom mounting apertures 40 and 42 of first mounting plate 30 when the first and second mounting plates 30, 32 are joined.

With additional reference to FIG. 2, the joining of the first and second mounting plates 30, 32 may be completed with fasteners 140 that are inserted through the top and bottom apertured mounting bosses 70, 84 as well as the top and bottom mounting apertures 40, 42 of first mounting plate 30. A nut 142 attaches to each fastener 140 within the respective top and bottom mounting aperture 40, 42. As the nut 142 is tightened the first and second mounting plates 30, 32 are drawn together for a tight fit and the nuts 142 rest inside their respective top and bottom mounting apertures 40, 42 such that they do not extend beyond, protrude past, or interrupt the front surface 16.

When the first and second mounting plates 30, 32 are joined the upper wall 78 and lower wall 80 pass into the opening in the recess 18 to define together with sidewalls 56,58 the channel 76 of the recess 18 in which the buckle 26 resides in its latched state.

Figure 5:
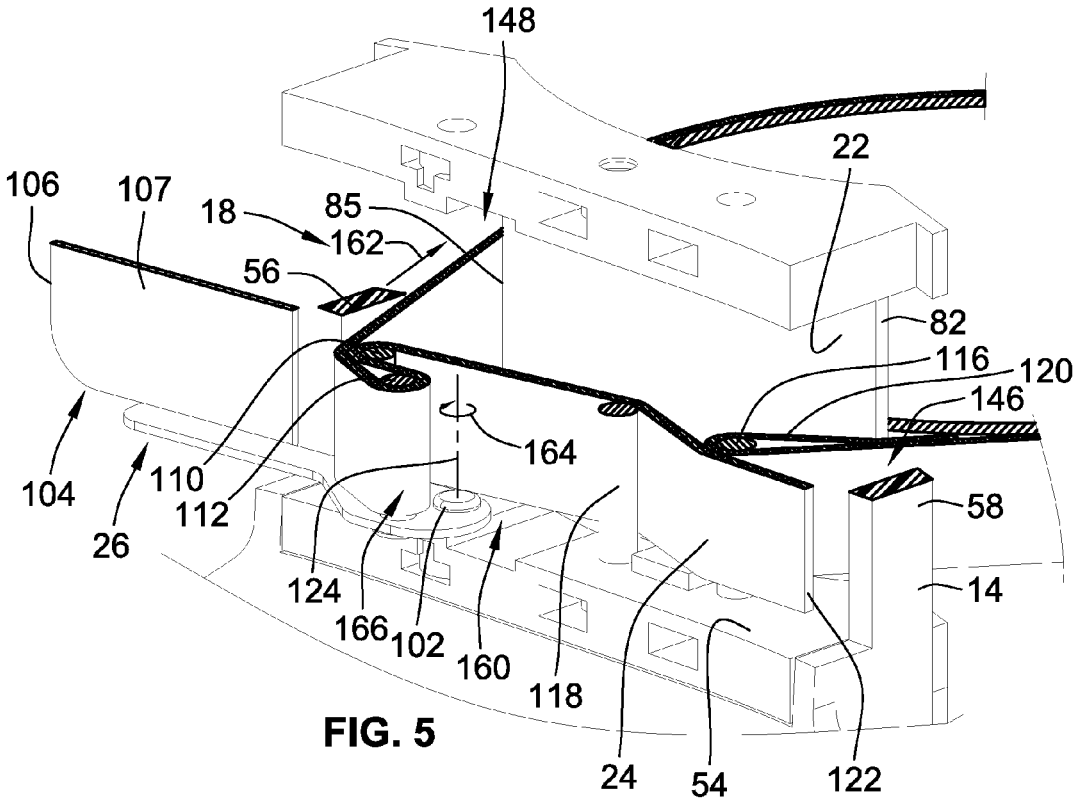
FIG. 5 is cross section take about line 5-5 of FIG. 1 but with the buckle in an unlatched state.
Figure 6:
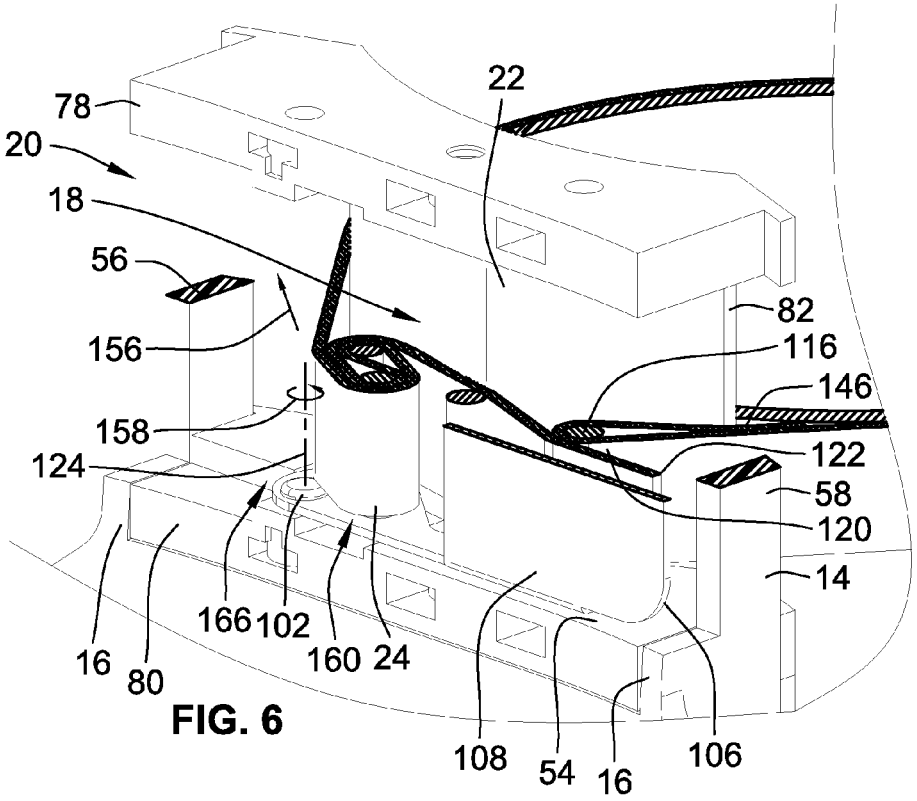
FIG. 6. is a cross section taken about line 5-5 of FIG. 1 with the buckle in a latched state.

FIGS. 5 and 6 illustrate the cross section of the buckle 26 and the strap 24 through recess 18 about line 5-5 of FIG. 1. FIG. 5 illustrates the buckle 26 in the latched state and FIG. 6 illustrates the buckle in the unlatched state.

To create the over the center function of the buckle 26, fixed end 120 of strap 24 is attached to recess pin 116 such that it may pivot about recess pin 116. The strap 24 extends through a first gap 146 in the recess 18 between side wall 58 of the recess 18 and an edge 83 of bottom wall 82 as it is wrapped counter clockwise in the illustrated figures around an underwater breathing gas 12 for diving operations. Clockwise and counterclockwise are used simply for illustrative purposes with respect to the drawings. Once strap 24 completely surrounds an underwater breathing gas tank 12, the strap 24 is passed through a second gap 148 in the recess 18 between an edge 85 of the side wall 56 of the recess 18 and the bottom wall 82 of the recess 18. Thereafter, the strap 24 is wrapped counter clockwise around buckle pin 112 and inserted between buckle pins 112 and 110 such that strap 24 wraps clock wise around buckle pin 110. Strap 24 then passes clockwise around recess pin 118 and passes between recess pin 118 and recess pin 116. Free end 122 of strap 24 is then wrapped counterclockwise around buckle pin 116 with the buckle 26.

By unlatched state of the buckle 26 it is meant that the strap 24 is adjustable such that it may be tightened or loosened by decreasing or increasing its length as it surrounds an underwater breathing gas tank 12. In the unlatched state, buckle handle 104 is located at least partially outside the recess 18 such that the buckle front face 108 is facing toward the underwater breathing gas tank 12 while the buckle back face 107 faces away from the underwater breathing gas tank 12 and towards a diver's back when the underwater breathing gas tank 12 is placed in a position to be operably coupled to the tank mounting structure 14. In the unlatched state of the buckle 26, the outermost periphery of the buckle at the second end 106 is outside of the recess 18 extending laterally beyond side wall 56 such that buckle front and back faces 106, 107 are generally parallel to the bottom surface 22 of the recess 18. A portion of the handle 104 of the buckle 26 extends into a portion of the recess 18 that extends into the side 19, 21 of the tank mounting structure 14 when the buckle 26 is in the unlatched state. This provides a visual indication to the diver that the buckle 26 is unlatched. It also allows the diver to easily grip and apply force to the buckle 26 to transition it into the latched state.

In the unlatched state of the buckle 26, the length of the strap 26 is adjusted by pulling on the free end 122 of the strap 24 to move the strap in a generally counterclockwise manner to tighten and thus shorten the length of the strap 24 length as it surrounds an underwater breathing gas tank 12. On the other hand, the length of the strap 24 as it surrounds the underwater breathing gas tank 12 may be increased, that is loosened in the open state of the buckle 26 by pulling on any part of the strap 24 away from the fixed end 120 to move the strap 24 in a generally clockwise direction. Strap 24 may also have pre-configured visible lines (not illustrated) along its length for alignment with the tank mounting structure 14, buckle 26 or the strap 24 or all to advantageously provide a visible reference for adjusting the length of the strap 24 to tightly fit around varying predetermined circumferences of underwater breathing gas tank as they are operably coupled to the tank mounting structure 14.

Also illustrated in FIG. 5 is bottom mounting pin 102 which together with top mounting pin 104 (not illustrated in FIG. 6) defines the rotation axis 124 about which buckle 26 rotates as it passes between the unlatched state of the buckle 26 (which may also be interchangeably referred to as the open state of the buckle 26) and the latched state of the buckle 26 (which may also be interchangeably referred to as the closed state of the buckle 26).

Buckle 26 is manipulated to rotate in a counterclockwise rotation about rotation axis 124 to transition from the unlatched state to the latched state. In transition, at least a portion of the handle 104 extends out of the opening 20 of the recess 18 beyond the front surface 16. The buckle 26 is an over center mechanism such that in the latched state, the strap 24 creates a force 156 that is directed to generate a latching torque 158 in a first angular direction on the buckle 26 around the rotational axis 124 biasing the buckle 26 toward the latched state and maintaining the buckle in the latched state. In the latched state, the force 156 generated by the strap 24 on the buckle 26 lies on a first side 160 of rotational axis 124. In the unlatched state, the strap 24 creates a force 162 that generates a torque 164 on the buckle 26, in a direction opposite torque 158, around the rotational axis 124 biasing the buckle 26 toward the unlatched state. In the unlatched state the force 162 acts on an opposite second side 166 of rotational axis 124 as force 156.

As illustrated in FIG. 6, when the buckle 26 is in the latched state the length of the strap 24 is fixed and the buckle 26 is located entirely within the recess 18 such that it does not extend beyond the front surface 16 or the sides 19, 21 of the tank mounting structure 14. In the latched state, the front face 108 of the buckle 26 is located entirely within recess 18 and opening 20 such that the front face 108 does not extend beyond front face 16 of the tank mounting structure 14. Advantageously, in the latched state, when in a dive, the buckle 26 is protected from becoming inadvertently unlatched, because it is protected by the bottom wall 82 of the recess 18 as well as a diver's back over opening 20 such that an object or structure cannot penetrate the recess 18 to generate enough force to overcome the torque keeping the over-the-center buckle 26 closed in the latched state.

Further the handle 104 is advantageously dimensioned such that its length prevents rotation from the latched state to the unlatched state when worn by a diver as the handle 104 will hit the diver's back prior to being able to be rotated to the unlatched state. The particular relevant dimension is the distance from rotation axis 124 relative to spacing between rotation axis 124 and a diver's back when worn. Accordingly, in other embodiments, tank mounting structure 14 provides for a recess 18 that receives a buckle 26 such that buckle 26 may extend beyond opening 20 and front face 16 towards a divers back. In such embodiments, at least a portion of buckle 26 remains in the recess 18. In the latched state, when the tank mounting structure 14 is worn on a diver's back, the diver's back prevents the buckle 26 from inadvertently transitioning from the latched state to the unlatched state.

Figure 7:
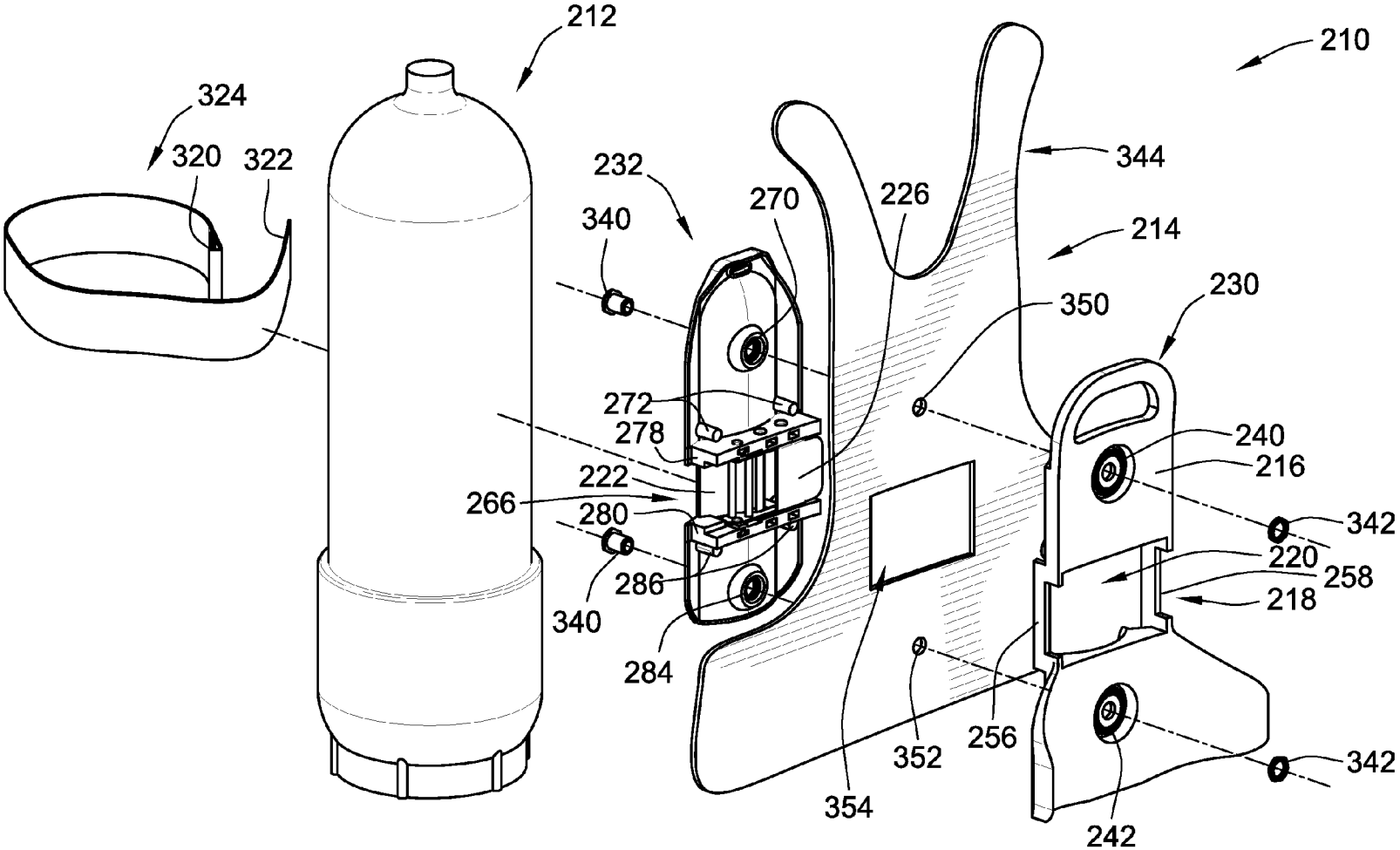
FIG. 7. is an exploded view of a second embodiment of a back pack having a dive bladder.

Turning now to FIG. 7, back pack 110 is illustrated. Back pack 210 is identical to back pack 10 except back pack 210 includes dive bladder 344.

The back pack 210 for an underwater breathing gas tank 212 includes a first mounting plate 230 and a second mounting plate 232 releasably coupled to one another. By releasably coupled it is understood that the first and second mounting plates 230 and 232 may be joined together for use and then as desired for any number of reasons such as maintenance or cleaning by way of non-limiting examples the first and second mounting plates 230, 232 may be easily disassembled/unjoined as opposed to a forced disassembly, for example, by having to break welds or rivets.

The first and second mounting plates 230, 232 define a tank mounting structure 214 having a front surface 216 facing away from a gas tank 212 when a gas tank 212 is operably mounted to the tank mounting structure 214. The tank mounting structure 214 defines a recess 218. The front surface 216 defines an opening 220 of the recess 218. The tank mounting structure 214 defines a bottom surface 222 of the recess 218 opposite the opening 220 in the front surface 216. The back pack 210 includes the dive bladder 344 that is releasably coupled between the first and second mounting plates 230, 232.

The dive bladder 344 includes a first 350 and second 352 dive bladder aperture. The first dive bladder aperture 350 aligns with the top apertured mounting boss 270 of the second mounting plate 232 and the top mounting aperture 240 of the first mounting plate 230 such that fastener 340 may be easily inserted therethrough and fastened with nut 342. The second dive bladder aperture 352 aligns with the bottom apertured mounting boss 284 of the second mounting plate 232 and the bottom mounting aperture 242 of the first mounting plate 230 such that fastener 340 may be easily inserted therethrough and fastened with nut 342.

Dive bladder 344 may further include a third dive bladder aperture 354 located between the first and second dive bladder apertures 350, 352. The third dive bladder aperture 354 is formed such that it permits the upper 278 and lower 280 walls of the middle portion 266 of the second mounting plate 232, the top 272 and bottom 286 male mounting members and the first 256 and second 258 side walls of the recess 218 to pass therethrough as the first 230 and second 232 mounting plates are joined to form the tank mounting structure 214.

Dive bladder 344 is made of a material that is flexible enough to permit the dive bladder 344 to conform to the convex front surfaces of the second mounting plate 232 and the concave back surfaces of the first mounting plate 230 such that they cooperate with one another to ensure a tight fit between the first 230 and second 232 mounting plates when they are releasably joined together in the manner heretofore discussed. Specifically, the dive bladder 344 may be a single bladder made of high frequency weldable fabric such as polyurethane coated nylon fabric (210, 420, 840 or 1000 denier) or dive bladder 344 may be a double bladder that includes a polyurethane inner air-cell and an outer bladder made of nylon fabric just discussed but without the polyurethane coat.

Back pack 210 further includes the over the center buckle 226 and the strap 324. The first end of the 320 of the strap 324 is pivotally attached the over the center buckle 226. The over center buckle 226 receives the second end 322 of the strap 324 for securing the strap 324 in a fixed position. The strap 324 in its fixed position surrounds an underwater breathing gas tank 212, the dive bladder 344, the tank mounting structure when an underwater breathing gas tank 212 is operably connected to the back pack 210 for a dive. When the strap 324 is in the fixed position, the buckle 226 is located within the recess 218 between the bottom surface 222 and the opening 220 defined by the front surface 216 of the tank mounting structure 214.

With reference to back packs 110, 210, the tank mounting structure 14, 214 may be made of fiberglass reinforced nylon. The fastener 140, 340 and nut 340, 342 may be made of nickel/chrome plated brass or stainless steel. The buckle 26, 226 may be made of stainless steel or it may be of injection molded fiberglass reinforced nylon. The strap 24, 324 may be made of polyester or nylon based webbing.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A back pack for an underwater breathing gas tank comprising:

a tank mounting structure having a front surface facing away from the underwater breathing gas tank when the underwater breathing gas tank is operably mounted to the tank mounting structure, the tank mounting structure defining a recess, the front surface defining an opening of the recess, the tank mounting structure defining a bottom surface of the recess opposite the opening in the front surface;

a strap;

a buckle having a latched state for securing the strap in a fixed position for securing the underwater breathing gas tank to the tank mounting structure, the buckle, when in the latched state, positioned at least partially within the recess; and wherein the tank mounting structure includes a first mounting plate defining, at least in part, the recess and a second mounting plate defining at least in part, the bottom surface of the recess opposite the opening in the front surface.

2. The back pack of claim 1, wherein the second mounting plate is located between the first mounting plate and the gas tank when the gas tank is mounted to the tank mounting structure.

3. The back pack of claim 1, wherein a dive bladder is fixed between the first mounting plate and the second mounting plate.

4. A back pack for an underwater breathing gas tank comprising:

a tank mounting structure having a front surface facing away from the underwater breathing gas tank when the underwater breathing gas tank is operably mounted to the tank mounting structure, the tank mounting structure defining a recess, the front surface defining an opening of the recess, the tank mounting structure defining a bottom surface of the recess opposite the opening in the front surface;

a strap;

a buckle having a latched state for securing the strap in a fixed position for securing the underwater breathing gas tank to the tank mounting structure, the buckle, when in the latched state, positioned at least partially within the recess; and wherein the opening of the recess in the tank mounting structure includes a portion that extends into a side of the tank mounting structure as well as the front surface;

a handle portion of the buckle extends into the portion of the recess that extends into the side of the tank mounting structure when the buckle is in an unlatched state.

5. The back pack of claim 4, wherein the tank mounting structure defines an outer periphery and the handle extends out of the outer periphery defined by the tank mounting structure in the unlatched state and is at least partially within the outer periphery in the latched state.

6. A back pack for an underwater breathing gas tank comprising:

a tank mounting structure having a front surface facing away from the underwater breathing gas tank when the gas tank is operably mounted to the tank mounting structure, the tank mounting structure defining a recess, the front surface defining an opening of the recess, the tank mounting structure defining a bottom of the recess opposite the opening in the front surface;

a buckle having a latched state for securing a strap in a fixed position for securing the underwater breathing gas tank to the tank mounting structure, the buckle having a handle portion passes through the opening of the recess when the buckle transitions from an unlatched state to the latched state;

wherein the buckle is an over center buckle; and wherein the handle extends out of the recess and the outer periphery when the buckle is in the unlatched state.

7. A back pack for an underwater breathing gas tank comprising:

a tank mounting structure having a front surface facing away from the underwater breathing gas tank when the gas tank is operably mounted to the tank mounting structure, the tank mounting structure defining a recess, the front surface defining an opening of the recess, the tank mounting structure defining a bottom of the recess opposite the opening in the front surface;

a buckle having a latched state for securing a strap in a fixed position for securing the underwater breathing gas tank to the tank mounting structure, the buckle having a handle portion passes through the opening of the recess when the buckle transitions from an unlatched state to the latched state; and wherein the tank mounting structure includes a first mounting plate and a second mounting plate, the first mounting plate including a top portion, a middle portion, and a bottom portion; the top and bottom portions each have a mounting aperture for mounting the second mounting plate;

wherein the top portion of the first mounting plate comprises:

a top concave portion of the front surface of the tank mounting structure;

a carrying handle, the carrying handle extending away from an underwater breathing gas tank when the gas tank is operably mounted to the tank mounting structure;

wherein the middle portion includes the recess and defines a first side wall and a second side wall of the recess.

8. The back pack of claim 7, wherein the bottom portion defines a bottom concave portion of the front surface of the tank mounting structure, the bottom portion having opposed wings extending away from the gas tank when operably coupled to the tank mounting structure.

9. A back pack for an underwater breathing gas tank comprising:

a first mounting plate and a second mounting plate releasably coupled to one another, the first and second mounting plates defining a tank mounting structure having a front surface facing away from the underwater breathing gas tank when a gas tank is operably mounted to the tank mounting structure, the tank mounting structure defining a recess, the front surface defining an opening of the recess, the tank mounting structure defining a bottom surface of the recess opposite the opening in the front surface;

a dive bladder releasably coupled between the first and second mounting plates;

an over center buckle;

a strap;

wherein the over the center buckle secures the strap to fix a length of the strap surrounding an underwater breathing gas tank, the dive bladder and the tank mounting structure; the buckle, located at least partially within the recess when the strap is secured.

10. The back pack of claim 9, wherein the first mounting plate includes a handle and wherein the back pack is transportable via the handle.

11. The back pack of claim 10, wherein the second mounting plate includes a top, middle and bottom portion; wherein the middle portion defines channel having a top wall, a bottom wall and a portion of the bottom surface of the recess.

* * * * *